US006367178B1

(12) United States Patent
Chmiel

(10) Patent No.: US 6,367,178 B1
(45) Date of Patent: Apr. 9, 2002

(54) PROOF-OF-USE DEVICE AND BADGE SUITABLE FOR SUCH A DEVICE

(75) Inventor: Jehoshua Chmiel, München (DE)

(73) Assignee: WAW World Art Watch Vertriebs GmbH, München (DE)

( * ) Notice: Subject to any disclaimer, the term of this patent is extended or adjusted under 35 U.S.C. 154(b) by 0 days.

(21) Appl. No.: 09/296,970

(22) Filed: Apr. 22, 1999

Related U.S. Application Data

(63) Continuation-in-part of application No. 08/809,285, filed as application No. PCT/EP95/03543 on Sep. 8, 1995, now Pat. No. 6,185,848.

(30) Foreign Application Priority Data

Sep. 9, 1994 (DE) ..... P 44 3 171
Jan. 16, 1995 (DE) ..... 195 01 075

(51) Int. Cl.[7] ..... A44C 3/00

(52) U.S. Cl. ..... 40/1.5; 40/647; 40/661.04

(58) Field of Search ..... 40/1.5, 647, 652, 40/654.01, 658, 661.04, 661.06, 661.08, 666; 16/225; 24/3.1, 3.11, 3.12, 3.5, 3.7, 3.8, 3.9, 304, 327, 454, 703.1; 283/100, 103, 105

(56) References Cited

U.S. PATENT DOCUMENTS

| | | | |
|---|---|---|---|
| 1,054,192 A | | 2/1913 | Geddes |
| 1,438,433 A | | 12/1922 | Faith |
| 1,481,173 A | | 1/1924 | Wright |
| 1,567,315 A | | 12/1925 | Zaremba |
| 1,593,192 A | * | 7/1926 | Respess et al. |
| 1,895,704 A | | 1/1933 | Crosby |
| 2,226,969 A | | 12/1940 | D'Onofrio |
| 2,675,636 A | | 4/1954 | Schulz |
| 3,280,488 A | | 10/1966 | Rubin |
| 3,326,268 A | | 6/1967 | Dixon |

(List continued on next page.)

FOREIGN PATENT DOCUMENTS

| | | |
|---|---|---|
| DE | 865 516 | 2/1953 |
| DE | 15 36 709 B2 | 1/1970 |
| DE | 7025477 | 4/1971 |
| DE | 1 774 064 | 10/1971 |
| DE | 2 220 075 | 11/1973 |
| DE | 28 03 426 A1 | 9/1978 |
| DE | G 84 36 941.8 | 5/1985 |
| DE | 35 38 685 C2 | 8/1987 |
| DE | G 89 01 912.1 | 7/1989 |
| DE | G 93 03 264.1 | 7/1993 |
| DE | G 93 15 792.4 | 12/1993 |
| DE | G 94 00 704.7 | 5/1994 |
| DE | 43 02 170 A1 | 7/1999 |
| JP | 41-4679 | 3/1941 |
| JP | 54-66800 | 5/1979 |
| JP | 63-120281 | 8/1988 |
| JP | 4-126269 | 11/1992 |

*Primary Examiner*—B. Dayoan
*Assistant Examiner*—William L. Miller
(74) *Attorney, Agent, or Firm*—Westman, Champlin & Kelly, P.A.

(57) ABSTRACT

A proof-of-use device made of a thick fibrous sheet such as paperboard has manually tearable perforation defining an invalidation component on one side of the perforation and a basic component on the other side of the perforated region. The basic component has a front surface adaptable to receiving a badge image. A flexible region formed in the basic component defines a hinge along which the basic component is bendable over on itself. An attaching component is applied to at least one selected region of the basic component. Depending on configuration the attaching component may be on the front or back of the basic component. The attaching component and the hinge make the basic component attachable for wearing to display the badge image.

12 Claims, 6 Drawing Sheets

U.S. PATENT DOCUMENTS 3,355,826 A 12/1967 Klein et al. ..... 40/1.5
3,381,398 A 5/1968 Hu
3,488,812 A 1/1970 Gaydos
3,670,358 A 6/1972 Schwartz et al.
4,097,971 A 7/1978 Morris ..... 40/658 X
4,154,362 A 5/1979 McKenney
4,438,605 A 3/1984 De Lucia
4,536,924 A 8/1985 Willoughby
4,779,120 A 10/1988 Haas
4,780,934 A 11/1988 Vickera et al.
4,881,150 A 11/1989 Oyamada
4,980,679 A 12/1990 Klaubert
5,191,682 A 3/1993 Davis-Reardon et al.
5,261,583 A 11/1993 Long et al.
5,313,721 A 5/1994 Filden ..... 40/1.6
5,343,647 A * 9/1994 Bulka ..... 40/630
5,364,132 A 11/1994 Haas et al.
5,423,139 A 6/1995 Feldman
5,488,907 A 2/1996 Xu et al.
5,524,327 A 6/1996 Mickel et al.
5,640,742 A 6/1997 White et al.

* cited by examiner

120

PROOF-OF-USE DEVICE AND BADGE SUITABLE FOR SUCH A DEVICE

CROSS-REFERENCE TO RELATED APPLICATION

This application is a continuation-in-part of U.S. patent application Ser. No. 08/809,285, PROOF OF ENTRY DEVICE AND BADGE SUITABLE IN PARTICULAR FOR SUCH A DEVICE filed May 6, 1997, now U.S. Pat. No. 6,185,848, which is a 371 of PCT/EP95/03543, filed Sept. 8, 1995.

FIELD OF THE INVENTION

The present invention relates to proof-of-use devices formed of thick fibrous sheet material.

BACKGROUND OF THE INVENTION

Proof-of-entry devices, such as tickets, are known comprising a basic component and an invalidation component which are purchased together. For invalidating the proof-of-entry device, the invalidation component is torn off from the basic component. In particular in the case of exhibits and the like, basic components have increasingly been designed more elaborately so as to function as a souvenir for the purchaser of the proof-of-entry device. For instance, basic components have been designed as postcards. Such basic components of proof-of-entry devices are increasingly popular and have been traded as collectors' items.

SUMMARY OF THE INVENTION

This invention relates to proof-of-use devices for providing proof of receipt of service, merchandise, payment, consumption, information or entry, and methods for making such proof-of-use devices. The proof-of-use device is formed of thick fibrous sheet material and includes a basic component and an invalidation component which can be manually separated or torn along a perforated region in the thick fibrous material. Tearing off the invalidation component makes the remaining basic component invalid for a subsequent use. The basic component has a front surface adapted to display a badge image which can include pictures, text, drawing or a cartoon in any combination. The basic component can also be manufactured with a blank image to allow printing later. The basic component includes a flexible region making the basic component bendable with a bend that is relatively even and free of buckling. An attaching component is applied to at least one region of the basic component. Depending on the shape of the basic component and the positioning of the flexible region, the attaching component can be on the front or back side of the basic component. The basic component is bent over on itself, the attaching component and the bend serving to attach the basic component to fabric, clothing, a bag, a purse, and the like, thereby forming a badge.

DESCRIPTION OF THE PREFERRED EMBODIMENTS

Figure 1:
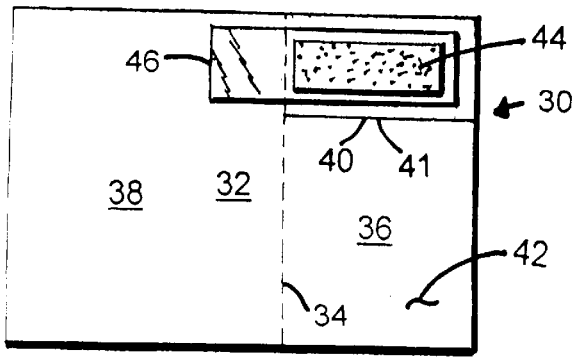
FIG. 1 shows a front view of a first embodiment of a proof-of-use device.
Figure 6:
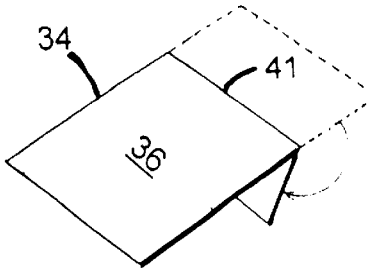
FIG. 6 shows an oblique view of the basic component of the first embodiment while it is being bent or folded.

In FIG. 1, the front side of a first embodiment of a proof-of-use device 30 is shown. Sheet 32 is formed of thick fibrous material, such as coated white paperboard with a thickness of 0.2 millimeter. Sheet 32 includes a perforated region 34 dividing the sheet 32 into a basic component 36 on one side of the perforated region 34 and an invalidation component 38 on the other side of perforation region 34. The perforated region 34 can be torn manually to separate the invalidation component 38 from the basic component 36. The basic component 36 has a flexible region 40 which is formed by scoring sheet 32 to form a scored region 41. The basic component 36 has a front surface 42 adapted to receive a badge image. The flexible region 40 formed in the basic component 36 defines a hinge along which the basic component 36 is bendable over on itself (FIG. 6). An attaching component 44 is applied, typically an adhesive applied by screen printing, to at least one selected region of the basic component 36 as shown in FIG. 1. When attaching component 44 is an adhesive, an adhesive release liner 46, typically a transparent thin plastic film, can be applied over attaching component 44 to prevent adhesion of adhesive in attaching component 44 to any surface until after the release liner 46 is removed. The attaching component 44 and the hinge make the basic component 36 attachable to clothing to display the badge image. When used, release liner 46 is firmly attached or bonded to the invalidation component 38, so that the release liner is removed from the adhesive when the invalidation component is manually torn or removed from the basic component 36 along perforated region 34. Removal of the invalidation component 38 invalidates the basic component for subsequent use, and its removal provides proof-of-use. The remaining basic component 36 serves as a badge. The basic component is folded over on itself and pressed up against clothing to attach it to the clothing. The adhesive used in attaching component 44 can be a releasable adhesive so that the badge can be removed from the clothing after use. The adhesive used in attaching component 44 can be sticky material or hook-and-loop fabric (also called "Velcro") or other attaching devices, depending on the application. The proof-of-use device is formed of fibrous material that is thicker than ordinary writing paper (0.1 mm) and preferably 0.2 mm or thicker. In a typical application, the proof-of-use device is sold at a retail facility and the invalidation component is removed to prove that a meal has been provided, while the basic component would allow the badgeholder access to drinks or games and also serve as a souvenir.

The proof-of-use device 30 can be manufactured with a blank badge image, allowing a printed badge image to be added, in other words, customized, later.

The proof-of-use device 30 can also be manufactured with a first printed portion of the badge image provided at the time of manufacture, and a second blank portion which can be printed later. The first portion can be printed on a printing press and the second portion is printed with an ink jet or laser printer at a later time. The later image can include a photo of the customer, the customer's name, the date, or other images. The customization can increase its value as a souvenir.

To further enhance its value as a souvenir, the badge image can be printed with printing materials which can be heat-transferred to light colored fabric, such as a tee shirt, at a later time using an ordinary laundry iron. These materials can be dye sublimation ink as described, for example in U.S. Pat. No. 5,488,907 Xu et al., or transfer sheets with ordinary ink, for example, Hewlett Packard Iron-On Transfers part no. C6049A.

Figure 2:
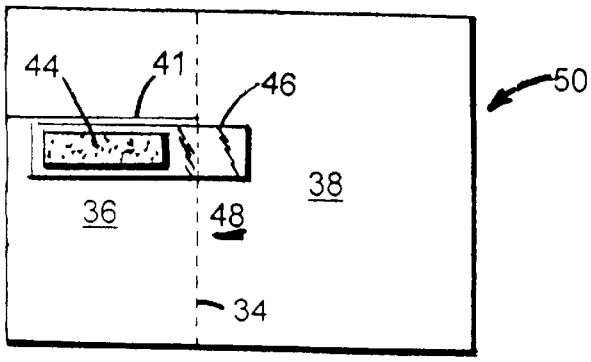
FIG. 2 shows a back view of a first alternate of the first embodiment.
Figure 4:
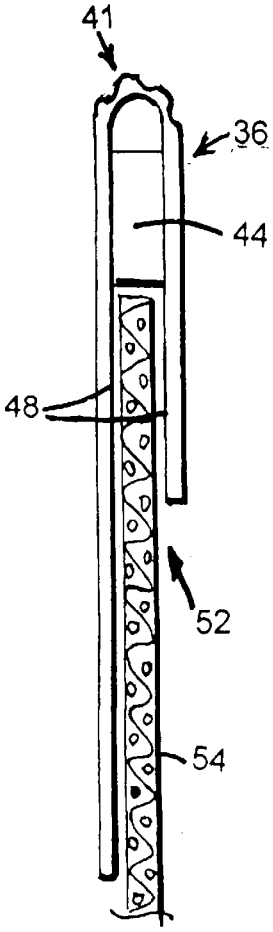
FIG. 4 shows the alternative in FIG. 2 attached to clothing.

In FIG. 2, a back side 48 of a proof-of-use device 50 is shown. The proof-of-use device 50 is similar to proof-of-use device 30, except that attaching component. 44 and optional adhesive release liner 46 are mounted on the back side 48 of proof-of-use device 50 instead of the front surface 42 of FIG. 1. When folded over on itself as shown in FIG. 4, the basic component 36 in proof-of-use device 50 attaches to the back side 48 forming a slot 52. The slot 52 is then slid over the top edge of a fabric pocket 54 as illustrated in FIG. 4. Scored region 41, as shown in FIG. 4, can include single or multiple parallel scorings to provide flexibility for bending without buckling or unevenness.

Figure 3:
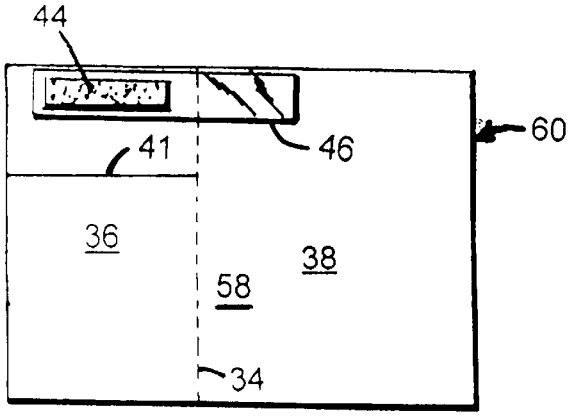
FIG. 3 shows a back view of second alternate of the first embodiment.
Figure 5:
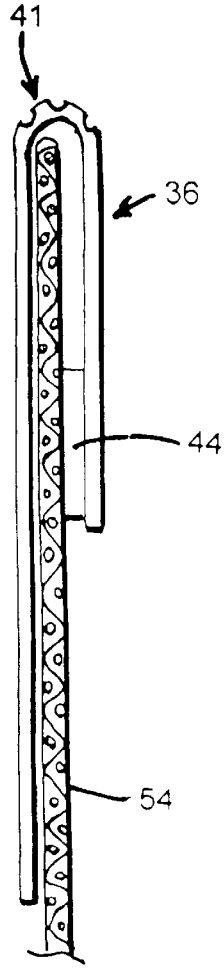
FIG. 5 shows the alternative in FIG. 3 attached to clothing.

In FIG. 3, a back side 58 of a proof-of-use device 60 is shown. The proof-of-use device 60 is similar to proof-of-use device 30, except that attaching component 44 and optional adhesive release liner 46 are mounted on the back side 48 of proof-of-use device 60 instead of the front surface 42 of FIG. 1. When folded over on itself as shown in FIG. 5, the basic component 36 in proof-of-use device 60 attaches to the fabric pocket 54 via attaching component 44. Scored region 41, as shown in FIG. 5, can include single or multiple parallel scorings to provide flexibility for bending without buckling or unevenness.

Figure 7:
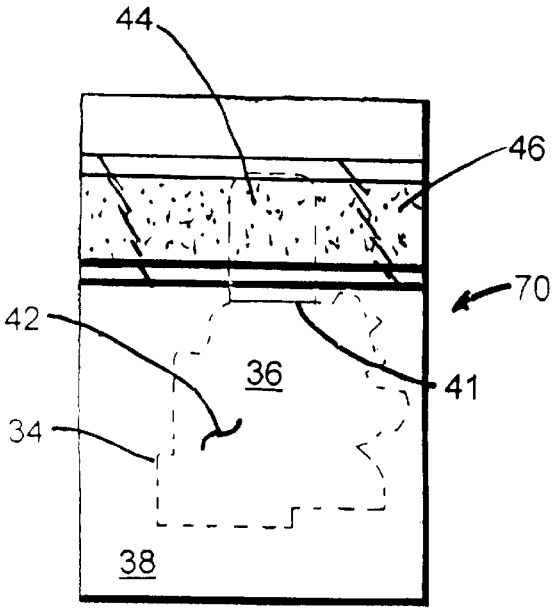
FIG. 7 shows a front view of a second embodiment of a proof-of-use device.
Figure 10:
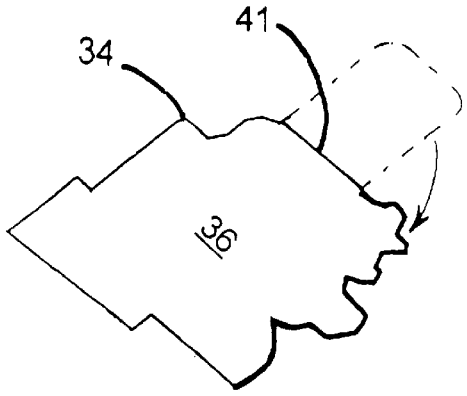
FIG. 10 shows an oblique view of the basic component of the second embodiment while it is being bent or folded.
Figure 8:
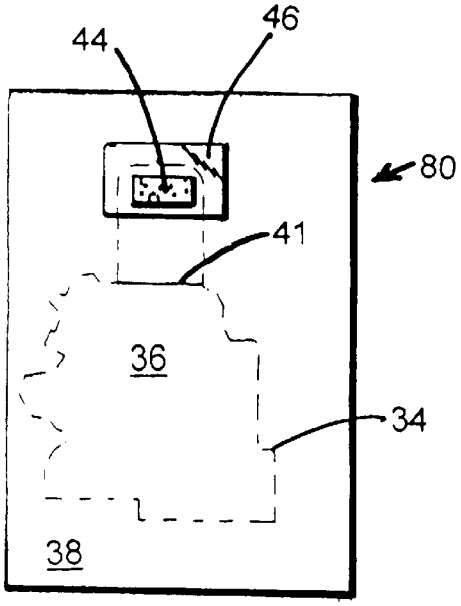
FIG. 8 shows a back view of a first alternate of the second embodiment.
Figure 9:
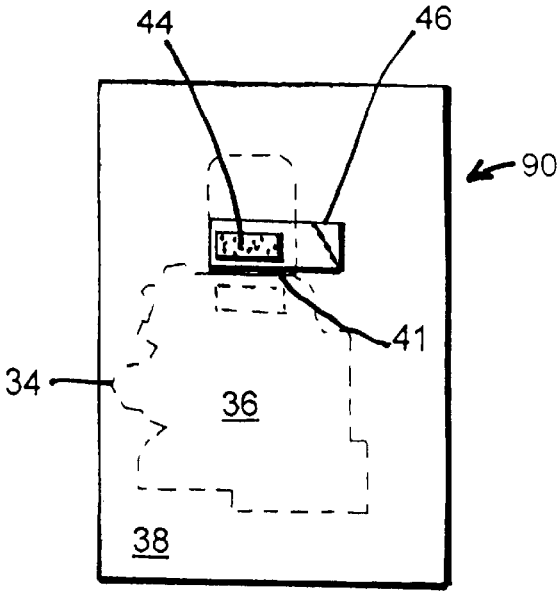
FIG. 9 shows a back view of second alternate of the second embodiment.

In FIG. 7, a further embodiment of a proof-of-use device 70 is illustrated in a front view. Device 70 has a perforated region 34 dividing an irregularly shaped basic component 36 set within a rectangular invalidation component 38. The irregular shape can conform to the outline of printed figure on the front surface 42 of the device 70 in FIG. 7. As shown in FIGS. 8–9 at 80 and 90 respectively, the attaching component 44 can be placed in various locations on the back sides of basic component 36 relative to the scored regions 41 to provide the same clothing attachment variations for FIGS. 7–9 that are shown in FIGS. 1–3. The basic component 36 of FIGS. 7–9 can be folded over on itself at scored region 41 as shown in FIG. 10.

Figure 11:
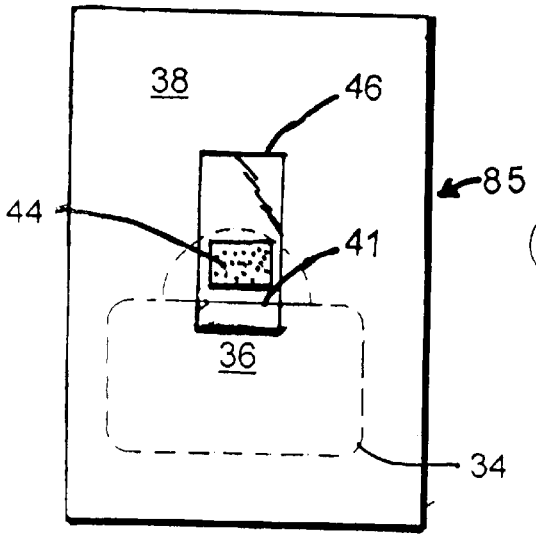
FIG. 11 shows a front view of a third embodiment of a proof-of-use device.
Figure 14:
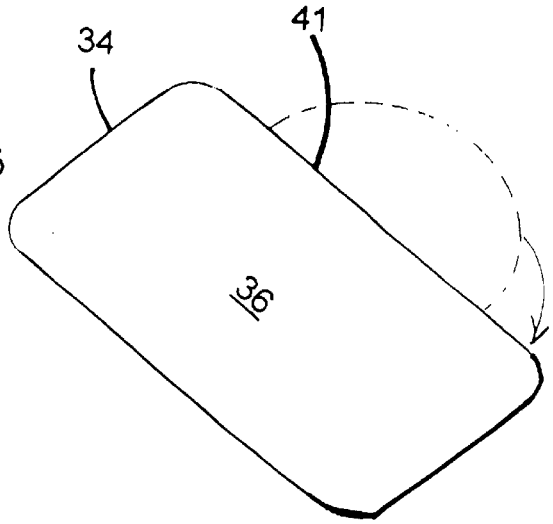
FIG. 14 shows an oblique view of the basic component of the third embodiment while it is being bent or folded.
Figure 12:
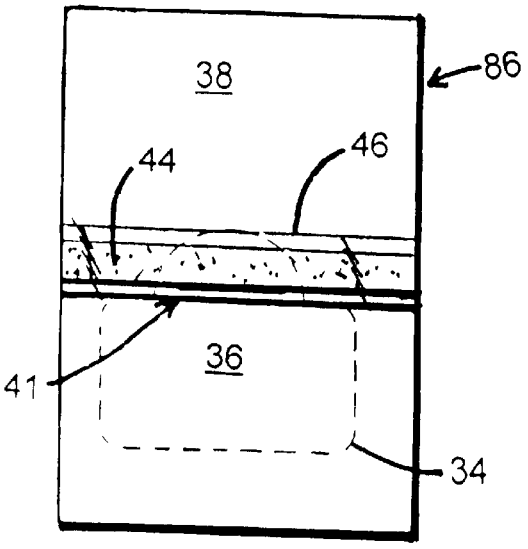
FIG. 12 shows a back view of a first alternate of the third embodiment.
Figure 13:
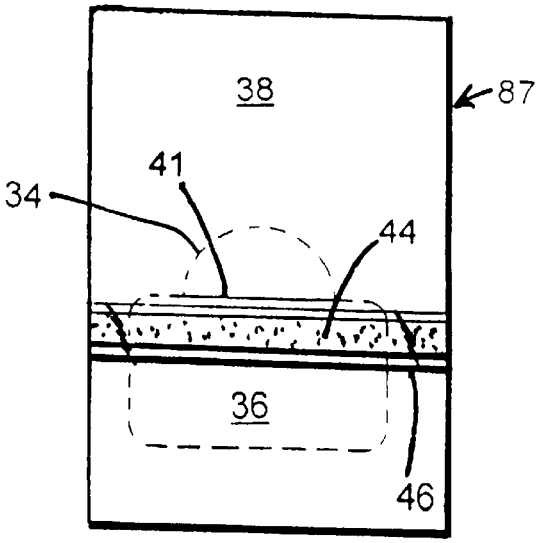
FIG. 13 shows a back view of second alternate of the third embodiment.

In FIG. 11, a further embodiment of a proof-of-use device 85 is illustrated in a front view. Device 85 has a perforated region 34 dividing an irregularly shaped basic component 36 set within a rectangular invalidation component 38. The irregular shape provides a convenient shape for an identification legend which can be printed on the front surface 42 of the device 85 in FIG. 11. As shown in FIGS. 12–13 at 86,87 respectively, the attaching component 44 can be placed in various locations on the back of basic component 36 relative to the scored region 41 to provide the same clothing attachment variations for FIGS. 11–13 that are shown in FIGS. 1–3. The basic component 36 of FIGS. 11–13 can be folded over on itself as shown in FIG. 14.

Figure 15:
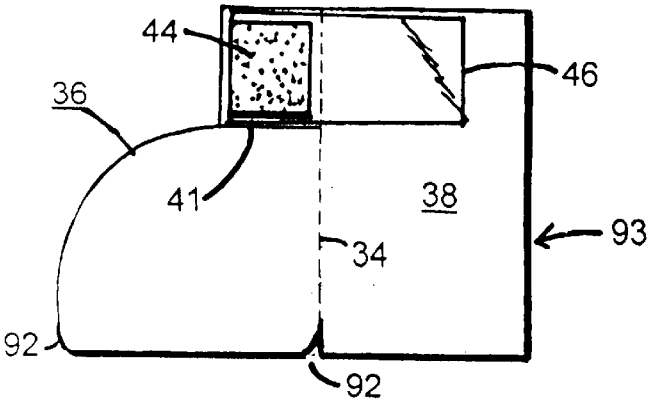
FIG. 15 shows a front view of a fourth embodiment of a proof-of-use device.
Figure 18:
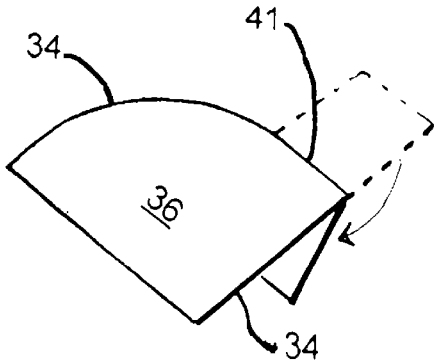
FIG. 18 shows an oblique view of the basic component of the fourth embodiment while it is being bent or folded.
Figure 16:
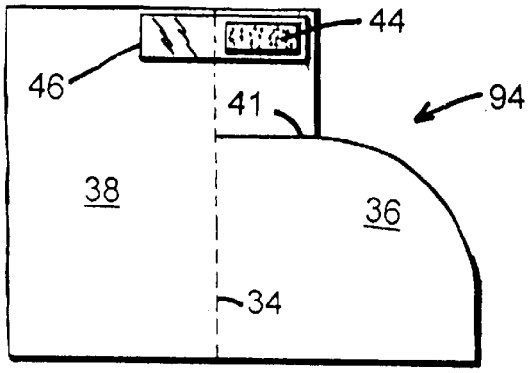
FIG. 16 shows a back view of a first alternate of the fourth embodiment.
Figure 17:
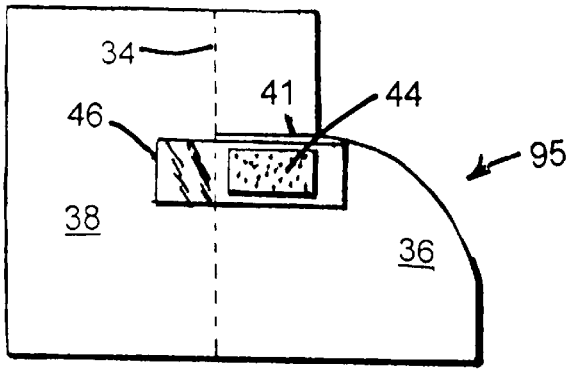
FIG. 17 shows a back view of second alternate of the fourth embodiment.

In FIG. 15, a further embodiment of a proof-of-use device 93 is illustrated in a front view. Device 93 has a perforated region 34 dividing an irregularly shaped basic component 36 from a rectangular invalidation component 38. The irregular shape can have corners 92 rounded to 1 millimeter or more radius, reducing curling of the basic component during use. The irregular shape can be any shape convenient for receiving a printed image on the front surface 42 of the device 93 in FIG. 15. As shown in FIGS. 16–17 in devices 94, 95 respectively, the attaching component 44 can be placed in different locations on basic component 36 relative to the scored region 41 to provide the same attachment variations for FIGS. 15–17 that are shown in FIGS. 1–3. The basic component 36 of FIGS. 15–17 can be folded over on itself as shown in FIG. 18.

Figure 19:
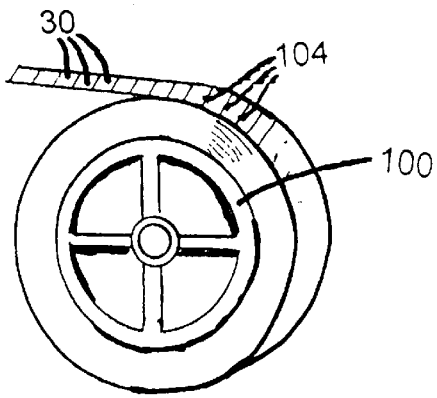
FIG. 19 shows many proof-of-use devices joined by perforations and wound on a dispensing reel.
Figure 20:
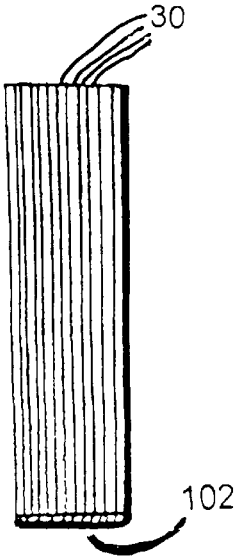
FIG. 20 shows many proof-of-use devices bound together in a dispensing book.

The proof-of-use devices 30 of the present invention can be joined together with additional perforations 104 in a long strip and wound on a dispensing reel 100 as shown in FIG. 19. The proof-of-use devices of the present invention can also be stacked and bound together with a binding 102 as shown in FIG. 20.

Figure 21:
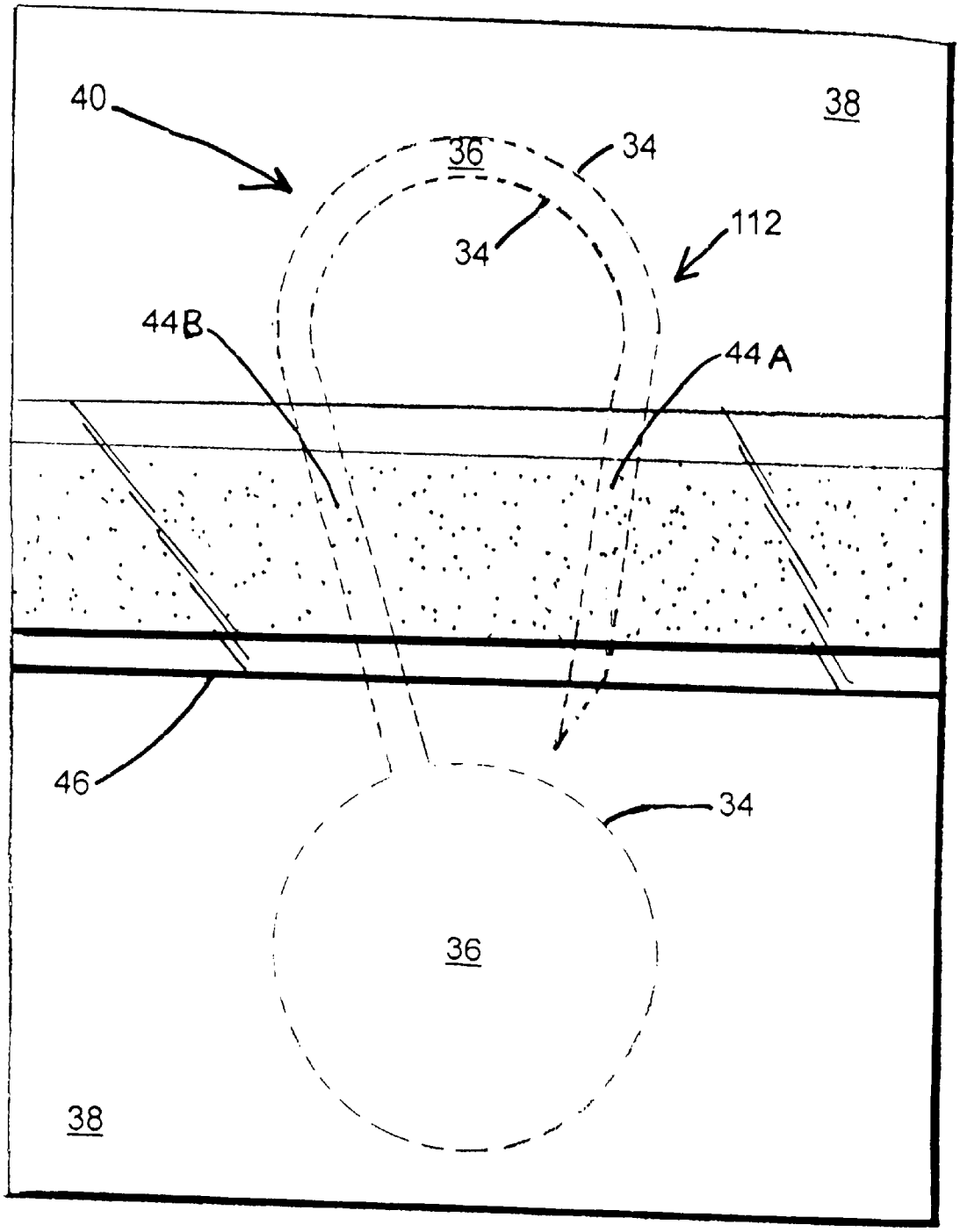
FIG. 21 shows a back view of a fifth embodiment of a proof-of-use device for attachment to a buttonhole.

In FIG. 21, a further embodiment of a proof-of-use device 110 is shown in back view. Device 110 has a perforated region 34 dividing an irregularly shaped basic component 36 from a rectangular invalidation component 38.

The irregular shape of the basic component 36 of FIG. 21 includes a portion shaped as a ribbon which can be passed through a buttonhole in fabric, or passed around a handle on a bag or purse when it is worn. The elongated ribbon 112 serves as a flexible region 40 allowing the basic component 36 of FIG. 21 to be folded over on itself without buckling or unevenness, and without the use of scoring. Regions 44A and 44B of adhesive attaching component 44 are brought together after threading elongated ribbon 112 through a buttonhole or around a handle of a bag or purse. In FIG. 21, adhesive attaching component 44 and adhesive release liner 46 extend across proof-of-use device 110 for convenience in mass production.

Figure 22:
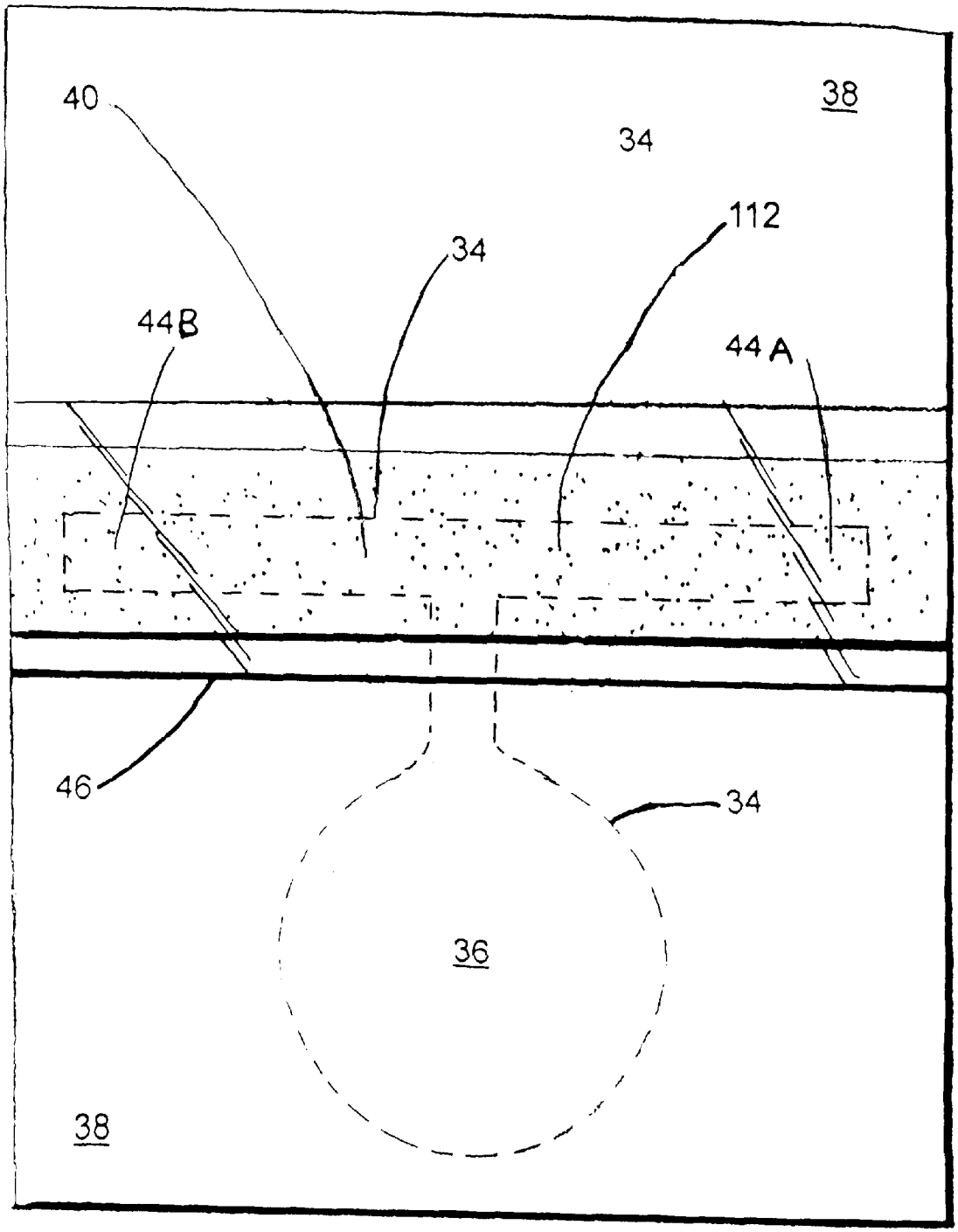
FIG. 22 shows a back view of a sixth embodiment of a proof-of-use device for attachment to a buttonhole.

In FIG. 22, a further embodiment of a proof-of-use device 120 is shown in back view. Device 120 has a perforated region 34 dividing an irregularly shaped basic component 36 from a rectangular invalidation component 38. The irregular shape of the basic component 36 of FIG. 22 includes a cross-shaped ribbon portion which can be passed through a buttonhole in fabric, or passed around a handle on a bag or purse when it is worn as a badge. The central region of the elongated ribbon. 112 serves as a flexible region 40 allowing the adhesive ends 44A, 44B of basic component 36 of FIG. 22 to be folded over on each other for attachment without buckling or unevenness, with or without the use of scoring. Regions 44A and 44B of adhesive attaching component 44 are brought together after threading elongated ribbon 112 through a buttonhole or around a handle of a bag or purse. In FIG. 22, adhesive attaching component 44 and adhesive release liner 46 extend across proof-of-use device 110 for convenience in applying continuous strips in mass production.

The term "fibrous sheet" as used in this application includes sheets or lamina formed of fibers closely matted or woven together to form a layer which is stiff enough to hold its natural flat shape, but also capable of being processed in selected regions to allow creasing and bending, and also smooth enough for printing. The fibers used can be natural, synthetic, recycled or garnetted. Various kinds of thick fibrous sheet materials can be used. These materials have a thickness in excess of 0.1 millimeters, and preferably approximately 0.2 millimeters (0.009 inch) or more to provide a limited degree of stiffness, inflexibility or resistance to bending as well as a limited degree of tear resistance. These can include heavy paper, paperboard, pasteboard, cardboard and the like. The thick fibrous sheet materials can be single ply or multiple ply depending on the durability desired. Sizing and coatings can be added to the thick fibrous sheet material to make it more suitable receive ink. Various types of know fibers, including fibers formed of resin, can be selected along with various known coating to receive the desired printing which can include a black, colored, fluorescent or holographic image.

Thick fibrous sheet materials are durable and resist bending and tearing, which is desirable for an ordinary badge, however resistance to bending and resistance to tearing need to be reduced in selected regions of the sheet to form a suitable proof-of-access device. In the present invention, the resistance to tearing is reduced by perforating the thick fibrous sheet material. Perforations are typically formed in a die cutting operation. The perforation allow for a neat, clean removal, or tearing off, of the invalidation component.

In the present invention, resistance to bending can be reduced by scoring the thick fibrous sheet material in a selected region. Scoring tends to break fibers and weaken bending strength. Scoring concentrates bending stress along the more flexible score line to provide a straight bend, avoiding buckling and unevenness in the hinge or bend. Scoring is typically done using a round-face scoring rule locked into a form on a platen or cylinder press. With embossed proof-of-use devices, scoring can also be accomplished as part of the embossing-process. Scoring can be single or multiple parallel indentations or scorings depending on the particular characteristics of the thick fibrous sheet material used. In some cases, heat or moisture can be used effectively to aid the scoring process. In the present invention, resistance to bending can also be reduced by forming a long,.thin loop or ribbon which can be passed through a buttonhole and bent over itself and attached with adhesive.

Attaching components used in the present invention are selected to match the needs of the particular application and can include adhesive films, adhesive foam, hook-and-loop fabric ("velcro"). Known adhesives, with or without aromatic additives, that are activated by heating, ultrasonics, light or solvents can be used depending on the application. Mechanical attachment devices such as various known types of snaps, clips and clasps can be used for attaching one part of the badge to another part of the badge.

Although the present invention has been described with reference to preferred embodiments, workers skilled in the art will recognize that changes may be made in form and detail without departing from the spirit and scope of the invention. For example, adhesive components can be placed on two locations on each basic device as illustrated in as FIG. 9 and so that when the badge is folded over, one adhesive component contacts the other adhesive component. Any feature of one embodiment or variation can be appropriately adapted to another embodiment or variation.

What is claimed is:

1. A proof-of-use device, comprising:

a thick fibrous sheet having a manually tearable perforated region defining an invalidation component on one side of the perforated region and a basic component on the other side of the perforated region, the basic component having a front surface adaptable to receiving a badge image;

a flexible region formed in the basic component defining a hinge along which the basic component is bendable over on itself;

an attaching component applied to at least one selected region of the basic component;

the attaching component and the hinge making the basic component attachable for wearing to display the badge image; and wherein the flexible region is a scored region in the thick fibrous sheet.

2. The device of claim 1 wherein the score region comprises multiple parallel scorings in the thick fibrous sheet.

3. The device of claim 2 wherein the thick fibrous sheet has a thickness in excess of 0.1 millimeter.

4. The device of claim 1 wherein the thick fibrous sheet has a thickness of 0.2 millimeter or more.

5. The device of claim 1, wherein the attaching component is an adhesive component.

6. The device of claim 5 wherein the adhesive component is releasable after use.

7. The device of claim 5 further comprising:

a release liner applied over the adhesive component to prevent adhesion of the adhesive component to another surface until after the release liner is removed.

8. The device of claim 7 wherein the release liner is attached to the invalidation component, so that the release liner is removed from the adhesive component when the invalidation component is manually torn and removed from the basic component.

9. The device of claim 1 wherein a blank badge image is provided on the front surface, allowing a printed badge image to be printed later.

10. The device of claim 1 wherein the badge image comprises a first printed portion provided on the front surface and a second blank portion which can be printed later.

11. The device of claim 1 wherein the badge image is provided with printing materials which are heat-transferable to fabric.

12. The device of claim 11 wherein the printing materials include dye sublimation ink.

* * * * *